US005275141A

United States Patent [19]

Tsunoda et al.

[11] Patent Number: 5,275,141

[45] Date of Patent: Jan. 4, 1994

[54] ACTUATOR

[75] Inventors: Akira Tsunoda, Kosai; Shigeki Okabe, Toyohashi, both of Japan

[73] Assignee: Asmo, Co., Ltd., Shizuoka, Japan

[21] Appl. No.: 48,762

[22] Filed: Apr. 16, 1993

Related U.S. Application Data

[63] Continuation of Ser. No. 842,928, Feb. 27, 1992, abandoned.

[30] Foreign Application Priority Data

May 31, 1991 [JP] Japan ..... 3-129949

[51] Int. Cl.[5] ..... F02D 7/00

[52] U.S. Cl. ..... 123/399

[58] Field of Search ..... 123/399; 74/513; 318/254

[56] References Cited

U.S. PATENT DOCUMENTS

| | | | |
|---|---|---|---|
| 4,938,190 | 7/1990 | McCabe | 123/399 |
| 4,961,355 | 10/1990 | Irino et al. | 74/513 |
| 4,963,800 | 10/1990 | Kajiwara et al. | 318/254 |
| 5,016,589 | 5/1991 | Terazawa | 123/399 |
| 5,078,110 | 1/1992 | Rodefeld | 123/399 |
| 5,113,824 | 5/1992 | Haubner | 123/399 |
| 5,133,321 | 7/1992 | Hering et al. | 123/399 |

FOREIGN PATENT DOCUMENTS

| | | |
|---|---|---|
| 2-86920 | 3/1990 | Japan . |
| 2-140419 | 5/1990 | Japan . |
| 4-49838 | 2/1992 | Japan . |

*Primary Examiner*—Raymond A. Nelli

*Attorney, Agent, or Firm*—Stetina and Brunda

[57] ABSTRACT

An improved actuator assembly is disclosed. The actuator has a rotor assembly rotatably mounted in a stator frame formed of a synthetic resin material. The stator frame has a borehole therein that receives a rotor assembly, a pair of mounting recesses, and a pair of bobbins portions. Each bobbin portion includes a slot. Induction magnets are mounted in each mounting recess of the stator frame such that they face the rotor assembly. A coils is would about each bobbin portion of the stator frame. The coils and induction magnets are angularly spaced about the rotor assembly. A core having a plurality of poles and holding portions, is also provided. Each core pole extends through an associated one of the bobbin slots and faces the rotor magnet. The holding portions are arranged to hold the induction magnets in place.

13 Claims, 5 Drawing Sheets

ACTUATOR

This application is a continuation of application Ser. No. 07/842,928, filed Feb. 27, 1992, now abandoned.

BACKGROUND OF THE INVENTION

This application claims the priority of Japanese Patent Application No. 3-129949 filed on May 31, 1991 which is incorporated herein by reference.

1. Field of the Invention

The present invention relates to an actuator, and more particularly, to an actuator which drives, for example, an intake valve in an internal combustion engine.

2. Description of the Related Art

A conventional actuator of this type is disclosed in Japanese Unexamined Patent Publication No. 2-140419. As shown in FIG. 5, such an actuator 30 comprises a four-pole stepping motor 31 whose core 32 is shaped into a square barrel. The core 32 includes a peripheral wall 32*a* which forms magnetic paths and four poles 33*a* to 33*d* which protrude inward from the peripheral wall 32*a*. The core 32 is formed of a plurality of laminated metal plates. Each of the metal plates is made through a pressing process and has four side edges linked to one another and four projections which extend inward from the respective side edges of the plate in association with the poles 33*a* to 33*d*, respectively. The core 32 has coils 34*a* to 34*d* wound around the poles 33*a* to 33*d*, respectively. A rotor 36 with a magnet 36*a* is held rotatable in the center of the core 32. The rotor 36 will be intermittently rotated every 90 degrees by properly changing the direction of conduction to one coil pair 34*b* and 34*d* while keeping the direction of conduction to the other coil pair 34*a* and 34*c* the same.

The prior art described above is designed to have the poles 33*a* to 33*d* projecting inward from the inner surface of the peripheral wall 32*a*. With this structure, to wind the coils 34*a* through 34*d* around the respective poles 33*a*–33*d* is relatively difficult because the adjacent poles, which have their coils already wound thereabout, and the peripheral wall 32*a* interfere with this work.

Since the coils 34*a* to 34*d* should be arranged so that they do not interfere with one another, clearances have to be provided between the coils. The internal space of the core 32 cannot therefore be effectively used.

The opposing pair of poles 33*a* and 33*c* in FIG. 5 may be replaced respectively with magnets 35*a* and 35*b* shown in FIG. 6. This provides another type of actuator in which the rotor 36 may be rotated in 90 degree intervals. This actuator has its core 31 provided with a pair of poles 33*b* and 33*d*. It is therefore easier to wind the coils 34*b* and 34*d* around the poles 33*b* and 33*d* in this case than in the above described prior art.

This modified actuator does not differ from the conventional case in that the peripheral wall 32*a* is still an obstruction when the coils 34*b* and 34*d* are to be wound around the poles 33*b* and 33*d*. Further, this modification gives rise to a new shortcoming where the magnets 35*a* and 35*b* have to be incorporated at the determined positions of the metallic core against their magnetic force.

SUMMARY OF THE INVENTION

It is therefore an object of the present invention to provide an actuator which can be made compact by accomplishing the effective use of its internal space, and is designed to facilitate the winding of coils around poles and to easily support magnets on the stator side at determined positions.

To achieve the above object, an actuator is provided that has a rotor assembly rotatably mounted in a stator frame formed of a synthetic resin material. The stator frame has a borehole therein that receives a rotor assembly, a pair of mounting recesses, and a pair of bobbins portions. Each bobbin portion includes a slot. Induction magnets are mounted in each mounting recess of the stator frame such that they face the rotor assembly. A coil is wound about each bobbin portion of the stator frame. The coils and induction magnets are angularly spaced about the rotor assembly. A core having a plurality of poles and holding portions, is also provided. Each core pole extends through an associated one of the bobbin slots and faces the rotor magnet. Each holding portion is arranged to hold an associated induction magnet in place.

In a preferred embodiment, the core is divided into a pair of core sections each of which has a core pole, a pair of holding arms that extend substantially in parallel with the core pole, and a linking portion for linking the core pole to the holding arms. The holding arms constitute the holding portions and are arranged to abut against outer walls of an associated induction magnet to hold the associated induction magnet in place.

BRIEF DESCRIPTION OF THE DRAWINGS

The invention, together with the objects and advantages thereof, may best be understood by reference to the following description of the presently preferred embodiment together with the accompanying drawings in which.

DETAILED DESCRIPTION OF THE PREFERRED EMBODIMENT

A preferred embodiment of the present invention as applied to an actuator for opening and closing an intake valve in an internal combustion engine for a vehicle will now be described referring to FIGS. 1 to 4.

Figure 4:
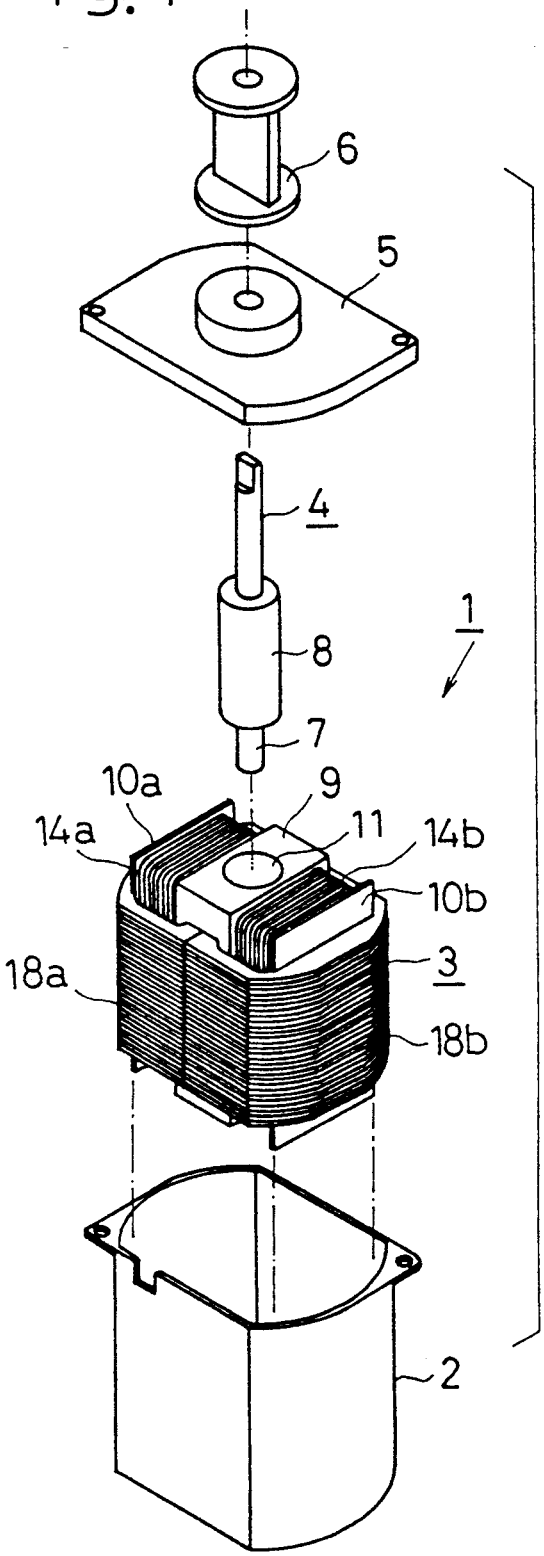
FIG. 4 is an exploded perspective view showing the whole actuator.
Figure 5:
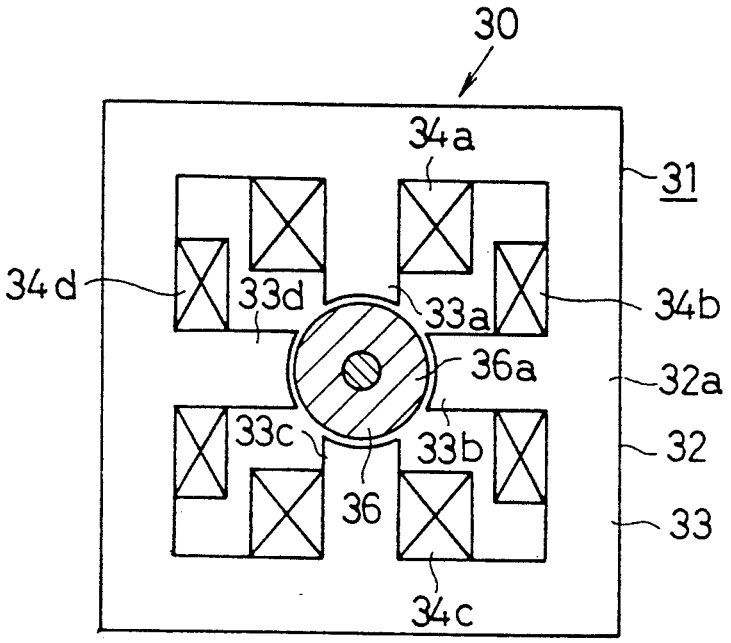
FIG. 5 is a plan view of a conventional actuator.
Figure 6:
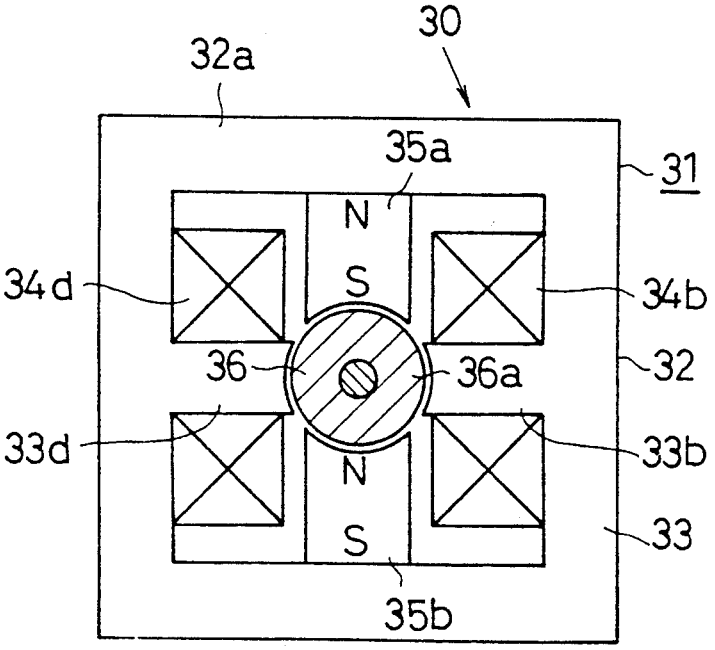
FIG. 6 is a plan view of another conventional actuator.

As shown in FIG. 4, an actuator 1 comprises a casing 2, a stator 3, a rotor 4, a cover 5 and a valve 6. The casing 2 is formed almost cylindrical, and has a bottom and a top opening. The stator 3 is retained in the casing 2. The cover 5 is attached to the opening of the casing 2 to prevent foreign substances from entering the casing 2. The rotor 4 includes a rotary shaft 7 and a magnet 8 fitted around the periphery of the rotary shaft 7.

The ends of the rotary shaft 7 are rotatably supported by the bottom of the casing 2 and the cover 5 respectively. The magnet 8 is inserted rotatable in the stator 3. The distal end of the rotary shaft 7 projects from the cover 5. A valve 6 is securely fitted over the distal end of the rotary shaft 7, so that the valve 6 and the rotary shaft 7 will integrally rotate.

Figure 1:
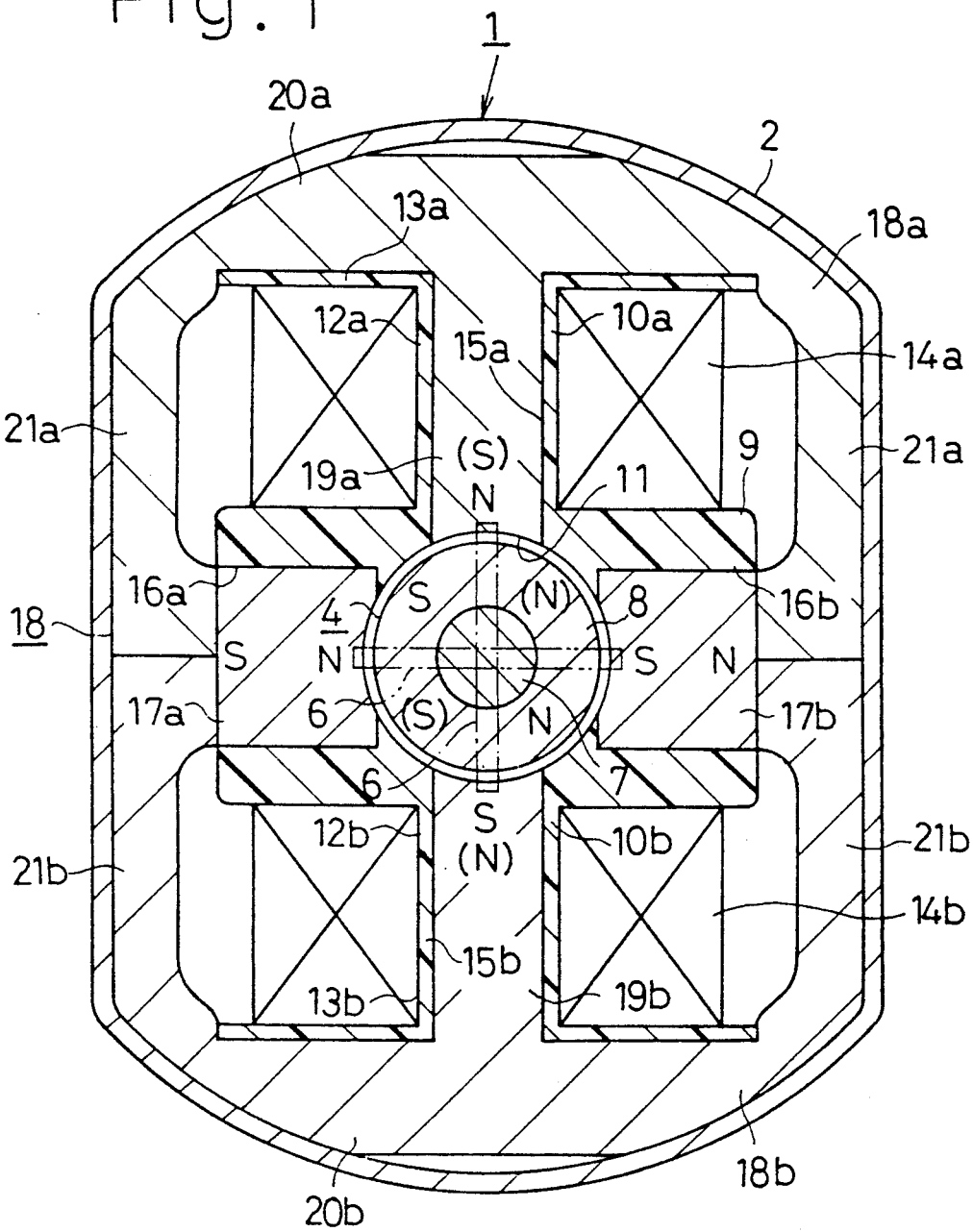
FIG. 1 is a cross section of an actuator according to one embodiment of the present invention.
Figure 2:
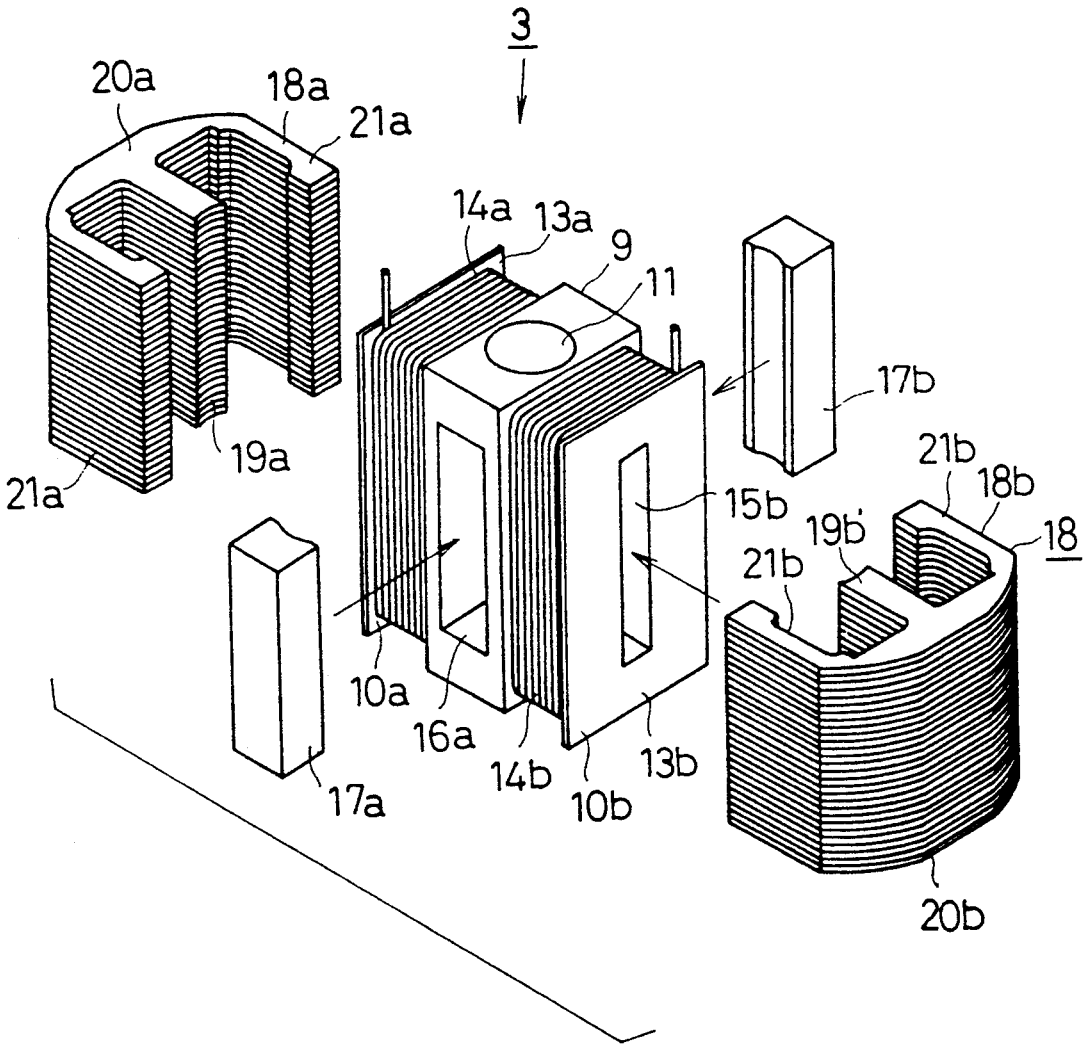
FIG. 2 is an exploded perspective view of the stator for the actuator shown in FIG. 1.
Figure 3:
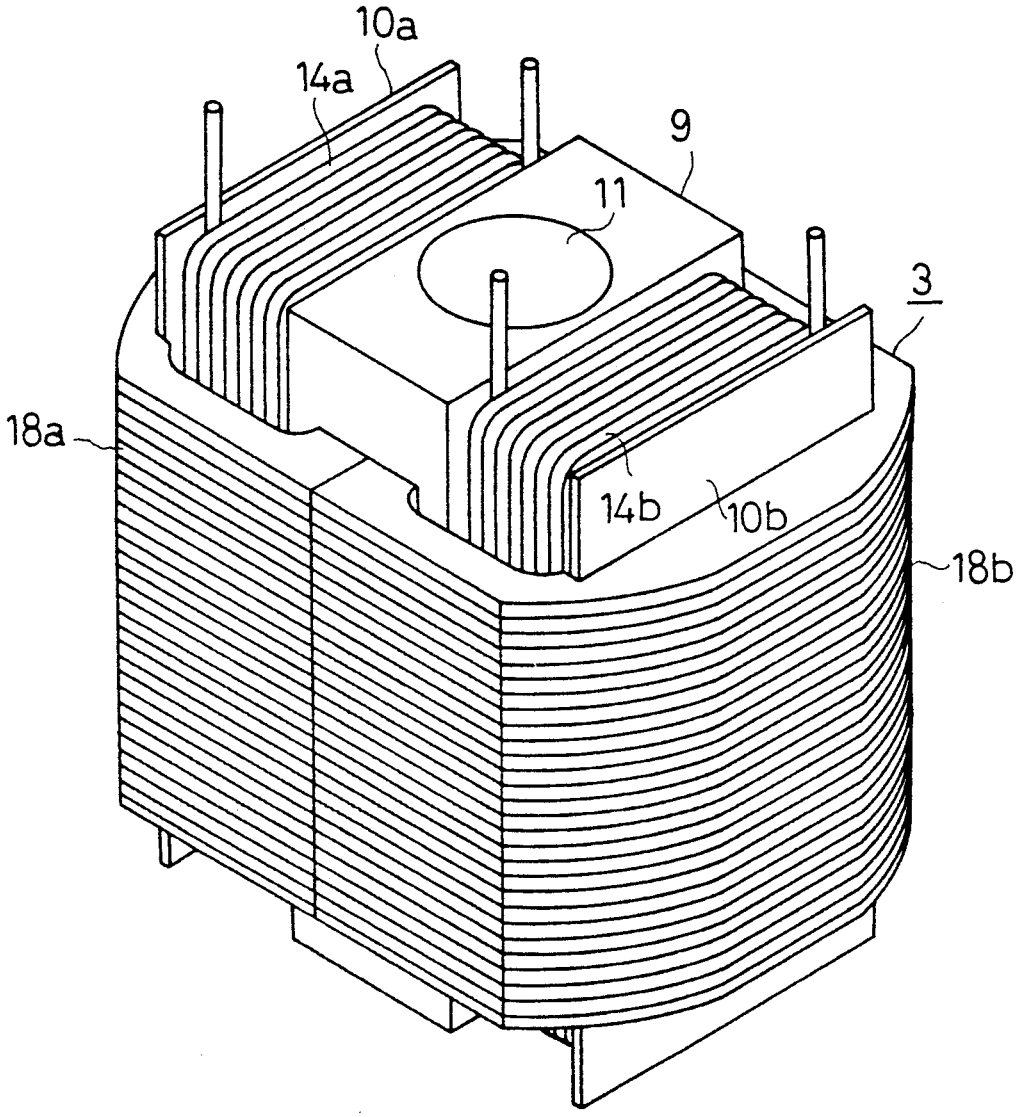
FIG. 3 is a perspective view of the stator shown in FIG. 2 in an assembled state.

The structure of the stator 3 will now be described in detail. The stator 3 is made of a synthetic resin and has a frame 9 that generally takes the shape of a rectangular parallelepiped, as shown in FIGS. 1 to 3. In the center of the frame 9, a vertically extending borehole 11 is provided, as seen in FIG. 2. The magnet 8 of the rotor 4 is inserted through the borehole 11. A pair of bobbins 10*a* and 10*b* are formed integrally with the frame 9, such that they extend to opposite sides of the frame 9. The bobbins 10*a* and 10*b* respectively include sleeves 12*a* and 12*b*, and flanges 13*a* and 13*b* projecting sideward from the respective sleeves 12*a* and 12*b*.

Stator coils 14*a* and 14*b* are wound around the sleeves 12*a* and 12*b* between the frame 9 and the flanges 13*a* and 13*b*, respectively. Further, rectangular slots 15*a* and 15*b* are formed in the bobbins 10*a* and 10*b*. The slots extend through the sleeves 12 from the flanges 13 to the borehole 11.

In a plane perpendicular to a plane where the bobbins 10*a* and 10*b* are formed and the axis of the borehole 11 lies, the frame 9 has a pair of magnet openings 16*a* and 16*b* each having a rectangular cross section, which are positioned on the respective sides (left and right sides in FIG. 1) of the borehole 11. The magnet openings 16*a* and 16*b* communicate with the borehole 11. First and second induction magnets 17*a* and 17*b* are inserted into the magnet openings 16*a* and 16*b*, facing the magnet 8 of the rotor 4. In this embodiment, that side of the first induction magnet 17*a* which faces the rotor 4 is set to the "N" pole, while that side of the second induction magnet 17*b* which faces the rotor 4 is set to the "S" pole. The outside portions of the induction magnets 17*a* and 17*b* are thus set to the "S" and "N" poles, respectively.

A core 18 includes two substantially E-shaped sections 18*a* and 18*b* respectively corresponding to the bobbins 10*a* and 10*b*. The E-shaped sections 18*a* and 18*b* are formed by a plurality of laminated metal plates which have been pressed into an almost E shape. The E-shaped sections 18*a* and 18*b* respectively include bases 20*a* and 20*b* to be joined to the flanges 13*a* and 13*b*, pairs of side walls 21*a* and 21*b* extending almost in parallel to each other along the sides of the bobbins 10*a* and 10*b*, and poles 19*a* and 19*b* to be inserted into the slots 15*a* and 15*b*. The free ends of the side walls 21*a* and 21*b* are joined to one another, as well as to the respective induction magnets 17*a* and 17*b*. The attraction forces of the magnet 8 of the rotor 4 and the induction magnets 17*a* and 17*b* securely hold the E-shaped sections 18*a* and 18*b*, and keep the induction magnets 17*a* and 17*b* in the magnet openings 16*a* and 16*b*.

The following description of this embodiment will be given of the case where the valve 6 is located at the closing position indicated by the alternate long and two short dash line shown in FIG. 1, i.e., a position where the valve 6 closes the intake path (not shown) of the internal combustion engine. In this case, a current flows through the coils 14*a* and 14*b* in one direction. The distal end of the first pole 19*a* is then magnetized to the "N" pole, and the distal end of the second pole 19*b* is magnetized to the "S" pole. At this time, in accordance with the magnetic forces of the induction magnets 17*a* and 17*b* and the poles 19*a* and 19*b*, the rotor 4 is kept stationary at the position shown in FIG. 1. In other words, the "S" pole of the rotor 4 is located between the first induction magnet 17*a* and the first pole 19*a*, while the "N" pole is set between the second induction magnet 17*b* and the second pole 19*b*.

To change the valve 6 to the opening position indicated by the alternate long and short dash line in FIG. 1, i.e., a position where the valve 6 opens the intake path of the internal combustion engine, the direction of conduction to the coils 14*a* and 14*b* should be reversed from the one in the previous case. The poles 19*a* and 19*b* are then inverted, so that the distal end of the first pole 19*a* may be "S", and that of the second pole 19*b* "N".

The "S" pole of the rotor 4 repels the first pole 19*a*, and is attracted by the first induction magnet 17*a* and the second pole 19*b* to be rotated to the middle point between the first induction magnet 17*a* and second pole 19*b*. At the same time, the "N" pole of the rotor 4 repels the second pole 19*b* and is attracted by the second induction magnet 17*b* and the first pole 19*a* to be rotated to the middle point between the second induction magnet 17*b* and the first pole 19*a*. In other words, the rotor 4 rotates 90 degrees counterclockwise in FIG. 1, thereby moving the valve 6 to the opening position indicated by the alternate long and short line in FIG. 1.

Reversing the direction of conduction to the coils 14*a* and 14*b* again can rotate the rotor 4 clockwise in FIG. 1 to return the valve 6 to the closing position.

In assembling the above-described actuator, the stator portion should be assembled first. That is, the coils 14*a* and 14*b* are wound around the bobbins 10*a* and 10*b* of the frame 9. Since there is no obstruction around the sleeves 12*a* and 12*b*, the winding can be done easily. The induction magnets 17*a* and 17*b* are inserted in the magnet openings 16*a* and 16*b*, respectively. As the casing 2 is made of a synthetic resin, the magnetic forces of the induction magnets 17*a* and 17*b* will not interfere with this assemblage, unlike in the prior art.

The poles 19*a* and 19*b* of the E-shaped sections 18*a* and 18*b* of the core 18 are retained in the associated slots 15*a* and 15*b*. At the same time, the free ends of the side walls 21*a* and 21*b* are joined to each other, and further to the corresponding induction magnets 17*a* and 17*b*. By the attraction forces of the induction magnets 17*a* and 17*b*, the E-shaped sections 18*a* and 18*b* are securely held to the frame 9, and the induction magnets 17*a* and 17*b* are retained in the magnet openings 16*a* and 16*b*. The assemblage of the stator is then complete.

After the stator portion is accommodated in the casing 2, the rotor 4 will be inserted into the borehole 11 of the frame 9. The opening of the casing 2 is then closed with the cover 5, and the valve 6 is fitted over the rotor 4, completing the assemblage of the actuator.

In this embodiment as described above, the core 18 is separated into E-shaped sections which will be assembled after the coils 14*a* and 14*b* have been wound around the frame 9. Unlike the case of winding coils directly around the respective poles of an integral core, this embodiment does not require that clearances for winding the coils be previously provided around the poles. It is therefore possible to design the actuator compact and also to facilitate the coil winding.

In this embodiment, the induction magnets 17*a* and 17*b* are retained in the frame 9 of a synthetic resin. As a result, the induction magnets 17*a* and 17*b* can be easily assembled without any influence of magnetic force. Further, the E-shaped sections 18*a* and 18*b* partially abut on the outer surfaces of the induction magnets 17*a* and 17*b*. In this way, the induction magnets 17*a* and 17*b* can be prevented from coming off the magnet openings 16*a* and 16*b* and can always be held at predetermined positions.

Although only an embodiment of the present invention has been described herein, it should be apparent to those skilled in the art that the present invention may be embodied in many other specific forms without departing from the spirit or scope of the invention. Therefore, the present example and embodiment are to be considered as illustrative and not restrictive and the invention is not to be limited to the details given herein, but may be modified within the scope of the appended claims.

What is claimed is:

1. An actuator comprising:

a rotor assembly that is rotatable about an axis, the rotor assembly including a rotor magnet;

an integral stator frame formed of a synthetic resin material, the stator frame having a borehole therein that receives the rotor assembly, a pair of mounting recesses, and a pair of bobbin portions, the bobbin portions each including a slot;

first and second magnets, each magnet being mounted in an associated mounting recess of the stator frame such that it faces the rotor assembly, the first magnet having a rotor-side portion magnetized as a north pole, and the second induction magnet having a rotor-side portion magnetized as a south pole;

first and second coils positioned in facing relationship on opposite sides of the rotor assembly, each coil being wound about an associated bobbin portion of the stator frame, said coils and magnets being angularly spaced about the rotor assembly; and a pair of core sections, each core section having a core pole, a pair of holding arms that extend substantially in parallel with the core pole, and a linking portion for linking the core pole to the holding arms, each core pole extending through an associated one of said bobbin slots and facing the rotor magnet, each of the holding arms being arranged to abut against outer walls of an associated magnet to hold the associated magnet in place.

2. An actuator according to claim 1, further comprising an intake control valve for an internal combustion engine, the intake control valve being attached to the rotor.

3. An actuator including a rotor assembly having a rotatable shaft and a rotor magnet mounted on the shaft, and a stator assembly for generating a magnetic field in order to cause the rotor assembly to rotate in a desired direction, the actuator comprising:

(a) the stator assembly including a frame having a central bore for receiving the rotor assembly in a surrounding relationship;

(b) said frame further including a plurality of recesses adapted to house a corresponding plurality of magnets, said magnets forming part of the stator assembly; and (c) the stator assembly further including:

(i) a plurality of bobbins extending from, and forming an integral part of said frame;

(ii) a plurality of windings wound around said bobbins, for forming a magnetizable assembly therewith; and (iii) electromagnet core disposed in an engaging relationship with said frame and bobbins under the magnetic force of the rotor magnet and said plurality of magnets.

4. The actuator according to claim 3, wherein said core includes two substantially similar E-shaped core sections, wherein each core section comprises:

(a) a base section which extends into two opposite and generally parallel side walls; and (b) a central pole which extends from said base section for engaging said bobbins.

5. The actuator according to claim 4, wherein each one of at least two of said bobbins includes a slot that is sized and dimensioned to house said central pole and wherein each one of said core sections includes a pair of free ends which engage said frame in order to further simplify the assembly of the stator assembly.

6. The actuator according to claim 5, wherein said frame includes two recesses, two corresponding magnets, and two bobbins.

7. The actuator according to claim 6, wherein said magnets are disposed in a generally facing and symmetrical relationship with respect to the rotor assembly and wherein said magnetizable assembly are disposed in a generally facing and symmetrical relationship with respect to the rotor assembly.

8. The actuator according to claim 7, wherein said recesses communicate with said central bore.

9. The actuator according to claim 8, wherein said slots communicate with said central bore.

10. The actuator according to claim 7, wherein each one of said permanent magnets includes one rotor side that faces the rotor and wherein said rotor sides have different polarities.

11. The actuator according to claim 3, further including an intake control valve connected to the rotor assembly, for use in an internal combustion engine.

12. The actuator according to claim 3, wherein said frame is comprised of synthetic resin material.

13. The actuator according to claim 4, wherein each one of at least two of said bobbins includes a slot that is sized and dimensioned to house said central pole and wherein each one of said core sections includes a pair of free ends which engage said magnets, in order to further simplify the assembly of the stator assembly.

* * * * *